US005544811A

United States Patent [19]

Tillery et al.

[11] Patent Number: 5,544,811

[45] Date of Patent: Aug. 13, 1996

[54] FLAME SPRAY SYSTEM AND METHOD OF USING THE SAME

[75] Inventors: Dean Tillery; Paul D. Musgrave; John McClusky; Russell L. Myers, all of San Antonio, Tex.

[73] Assignee: Acoatings, Inc., San Antonio, Tex.

[21] Appl. No.: 273,930

[22] Filed: Jul. 12, 1994

[51] Int. Cl.[6] ..... B05B 7/20

[52] U.S. Cl. ..... 239/13; 239/85; 239/144

[58] Field of Search ..... 239/1, 8, 13, 79, 239/85, 144

[56] References Cited

U.S. PATENT DOCUMENTS

| | | | |
|---|---|---|---|
| 2,108,998 | 2/1938 | Schori . | |
| 2,726,118 | 12/1955 | Jones et al. | 239/85 |
| 2,813,750 | 11/1957 | Marantz . | |
| 3,111,267 | 11/1963 | Shephard et al. | 239/85 |
| 3,438,579 | 4/1969 | Wiese | 239/85 |
| 4,500,038 | 2/1985 | DeFerrari et al. | 239/85 |
| 4,628,644 | 12/1986 | Somers | 51/427 |
| 4,632,309 | 12/1986 | Reimer | 239/8 |
| 4,865,252 | 9/1989 | Rotolico et al. | 239/8 |
| 4,934,595 | 6/1990 | Reimer | 239/8 |
| 4,964,568 | 10/1990 | Rotolico et al. | 239/8 |
| 5,135,166 | 8/1992 | Dietiker et al. | 239/8 |
| 5,148,986 | 9/1992 | Rusch | 239/85 |
| 5,207,382 | 5/1993 | Simm et al. | 239/79 |
| 5,230,470 | 7/1993 | Rajan et al. | 239/8 |
| 5,297,733 | 3/1994 | Burks et al. | 239/85 |

FOREIGN PATENT DOCUMENTS

| | | | |
|---|---|---|---|
| 533417 | 3/1993 | European Pat. Off. | 239/85 |
| 664930 | 1/1952 | United Kingdom . | |
| 829370 | 3/1960 | United Kingdom | 239/85 |

OTHER PUBLICATIONS

Data Sheet "Comparison of major thermal–spray coating processes", *Advanced Materials & Processes* (Feb. 1992, pp. 58–59).

"Characterizing Thermal–Spray Coatings", *Advanced Materials & Processes* (May 1992, pp. 23–27).

"1992 Thermal–Spray Buyer's Guide", *Advanced Materials & Processes* (May 1992, pp. BG1–BG14, 45–50).

"Healty gains seen in 1992", *Industry Surveys* (Nov. 5, 1992, pp. C30–C33).

"Earnings on the rebound", *Industry Surveys* (Jul. 22, 1993, pp. C4–C7).

"Technological advances reduce production costs", *Industry Surveys* (Nov. 5, 1992, pp. C41–C45).

"Volume–thermoplastic prices are likely to stay at low levels", *Modern Plastics* (Apr. 1992, pp. 22,67,71).

*Primary Examiner*—Andres Kashnikow

*Attorney, Agent, or Firm*—Gunn, Lee & Miller, P.C.

[57] ABSTRACT

A flame spray system and a method for applying uniform coatings of powdered plastics to surfaces which utilizes a pressurized carrier gas stream to transport plastic powder to a spray gun. The spray gun passes the powder through a flame produced at the end of the spray gun, melting the powder into droplets. When the molten plastic droplets strike the application surface, they adhere and combine to form a solid coat of plastic upon cooling.

29 Claims, 7 Drawing Sheets

FLAME SPRAY SYSTEM AND METHOD OF USING THE SAME

BACKGROUND OF THE INVENTION

1. Field of the Invention

Applicant's invention relates to a flame spray system and method for applying uniform coatings of powdered plastics to surfaces. Applicant's invention utilizes a pressurized carrier gas stream, normally air or nitrogen, to transport plastic powder to a spray gun. The powder passes through a flame at the head of the spray gun, melting the powder into droplets. When the molten plastic droplets strike the application surface, they adhere and combine to form a solid coat of plastic upon cooling.

2. Background Information

Various flame spray systems for applying powdered plastic to surfaces currently exist. Yet, these systems are not utilized extensively because they have design flaws, are not adjustable to meet spray pattern requirements, and for various safety reasons.

For example, due to design flaws in many of the prior art systems, powder begins to melt before it reaches the designated melt zone. This premature melting plugs up the system, which causes extensive delays due to system down time. Additionally, many of the prior art systems utilize a pressurized hopper to store the powder. As the powder exits the prior art hopper it begins to tunnel, releasing varying quantities of powder to the spray gun which cause an unsatisfactory application. In other prior art systems, the controls for regulating the flame are very near the flame. Consequently, the user's hands come in close proximity to the very hot flame when gas adjustments are required. In many instances, due to the close proximity to the flame, the controls become hot themselves and the user is either burned by touching the controls or contacting the flame while trying to adjust the controls.

Most prior art systems lack safety features which extinguish the flame if the gun is dropped. This lack of an emergency shut-off is a major detriment to prior art systems because if scaffolding is utilized, the user must crawl down several levels of the scaffolding to retrieve the lost gun. In the time it takes to retrieve the gun, a fire may have already broken out.

The prior art systems also do not enable the user to change the flame pattern or powder position to the flame, both of which are necessary for spraying varying meshes of powder. Finally, most prior art systems are very heavy and clumsy. The spray guns are unbalanced; the controls are inaccessible; and the powder metering systems are difficult to adjust. All of which leads to lower work efficiency and increased down time.

Consequently, a need exists for a flame spray system that allows the user to regulate both the flame temperature and the powder exiting position so that different meshes and types of powder may be utilized and various spray patterns may be achieved. In addition, a flame spray system is required that has flame controls positioned such that the applicant is not burned, yet allowing the user to control and manipulate the flame without accessing numerous distant parts of the system. Finally, the system should include safety features which ensure that the flame is extinguished if the spray gun is dropped or powder is not released for a set period of time adaptable by the user.

SUMMARY OF THE INVENTION

Applicant's present invention provides a flame spray system for and method of applying thermoplastic powdered material onto surfaces. The flame spray system has centrally located controls for controlling the flow of powder and flame supply gases to a spray gun. These controls are regulated by a pressurized carrier gas, usually air or nitrogen. The use of nitrogen allows finer mesh plastic to be utilized in the flame spray system. From this point, only the use of compressed air will be discussed, but it should be remembered that the carrier gas may be any gas compatible with the powder being used.

The flame spray system comprises a spray gun, a powder generation system, a gas supply system and a centrally located control system for controlling the flow of powder and flame spray gases to the spray gun.

The spray gun is comprised of a shaft section attached to a handle section. A trigger system is adjacent to the intersection of the shaft section and the handle section. The trigger system consists of a finger mount adjacent a spring loaded leg member which is capable of retracting into the handle section of the spray gun when the finger mount is squeezed. Also attached to the spray gun is a gas control mechanism, a gas mixing mechanism contiguous with the shaft section, a powder nozzle, and a control system communicating with the trigger system.

The centrally located control system is powered by pressurized air normally from an air compressor or some other source of compressed air. The pressurized air line is split by an air filtering system into two pressurized air lines. The first of the two pressurized air lines communicates with a powder metering system attached to a pressurized hopper which holds powder for release into the first pressurized air line. The outflow of the powder metering system is eventually transported to the spray gun for release through the powder nozzle.

The second of the two pressurized air lines communicates with a regulator and then is split into a flow line and interconnected pressure line, pinch valve pressure line, and control pressure line such that air may be bled off from the pinch valve pressure line and the pressure line through the control pressure line. The regulator is user adjustable for setting a preselected control pressure. A one-way rate control valve is attached to the pressure line before the interconnection of the pinch valve pressure line and the control pressure line. The one-way control valve restricts the amount of carrier gas flow to the pressure line, assuring a pressure drop will occur across the pressure line when the trigger system is activated.

A pinch valve is attached to the outflow from the powder metering system. The pinch valve has a control port which communicates with the pinch valve pressure line. When the pinch valve pressure line is at the preselected control pressure, the pinch valve is closed and the outflow from the powder metering system is completely restricted from flowing to the spray gun. As the pressure in the pinch valve pressure line begins to decrease, the pinch valve begins to open and the outflow from the powder metering system is transported to the spray gun. As the pressure in the pinch valve pressure line begins to increase, the pinch valve begins to close and the outflow from the powder metering system is restricted from flowing to the spray gun.

A shuttle valve is connected to the flow line allowing air to pass to the first leg of an air line that has a common juncture which creates three legs. The shuttle valve has a control port which communicates with the pressure line. When the pressure in the pressure line is less than the preselected control pressure, the shuttle valve is open and air from the flow line passes into the air line. When the control pressure is reached across pressure line, the shuttle valve is closed and air does not pass through the shuttle valve.

The second leg of the air line is attached to a regulator, attached to a vibrator line, connected to an air operated vibrator which is attached to the hopper near the powder metering system. When air flows through the second leg of the air line and eventually to the air operated vibrator, the air operated vibrator vibrates. The vibration assures powder in the pressurized hopper does not begin to tunnel. If the powder were to tunnel, fluctuating quantities of powder would be released into the pressurized air line, causing an undesirable application.

The third leg of the air line is connected to an air operated cylinder attached to a spring which activates a deadman control valve for regulating the flow of flame supply gases from the gas supply system to the spray gun. When the shuttle valve is open, air passes through the air line to the air operated cylinder which causes the cylinder to activate the spring which opens the deadman control valve and allows the flame supply gases to be transported to the spray gun. A combination of oxygen and propane are normally utilized, although compressed air may be used in place of the oxygen when a lower flame temperature is required. From this point forward, only the use of oxygen and propane will be discussed, although it should be remembered that the use of compressed air is interchangeable with the oxygen.

The control system in the spray gun is comprised of a poppet valve located in the handle section of the spray gun adjacent to the trigger system and connected to the control pressure line. The poppet valve is also attached to an air release line for receiving air from the control pressure line when the poppet valve is open. The poppet valve has a control mechanism activated by the trigger system. When the trigger system is activated, it engages the control mechanism, opening the poppet valve. When the poppet valve is open, air is released from the control pressure line into the air release line. This release effects a reduction in pressure in the pressure line and the pinch valve pressure line to a level below the preselected control pressure. This release of pressure causes the pinch valve to open, which allows air/powder to pass to the spray gun and simultaneously opens the shuttle valve which ultimately actuates the vibrator and the deadman control valve. When the trigger is released, pressure begins to build in the pressure line, control pressure line, and the shuttle valve pressure line. As the pressure builds in the pinch valve pressure line, the pinch valve begins to close, restricting powder flow to the spray gun. If the pressure ultimately reaches the preselected control pressure, the shuttle valve and the pinch valve close. The deadman control valve remains open For a user adjusted period of time after the shuttle valve and the pinch valve close.

The powder generation system is comprised of a hopper capable of being pressurized with a powder fill valve system corresponding to the top portion of the hopper and a powder metering system corresponding to the lower section of the hopper. The powder metering system includes a powder adjustment mechanism for adjusting the amount of powder that ultimately is transported to the spray gun. A powder cleanout system is attached to the powder metering system such that when the user has completed the job, the powder remaining in the hopper may be removed and reused.

DETAILED DESCRIPTION OF THE PREFERRED EMBODIMENT

Figure 1:
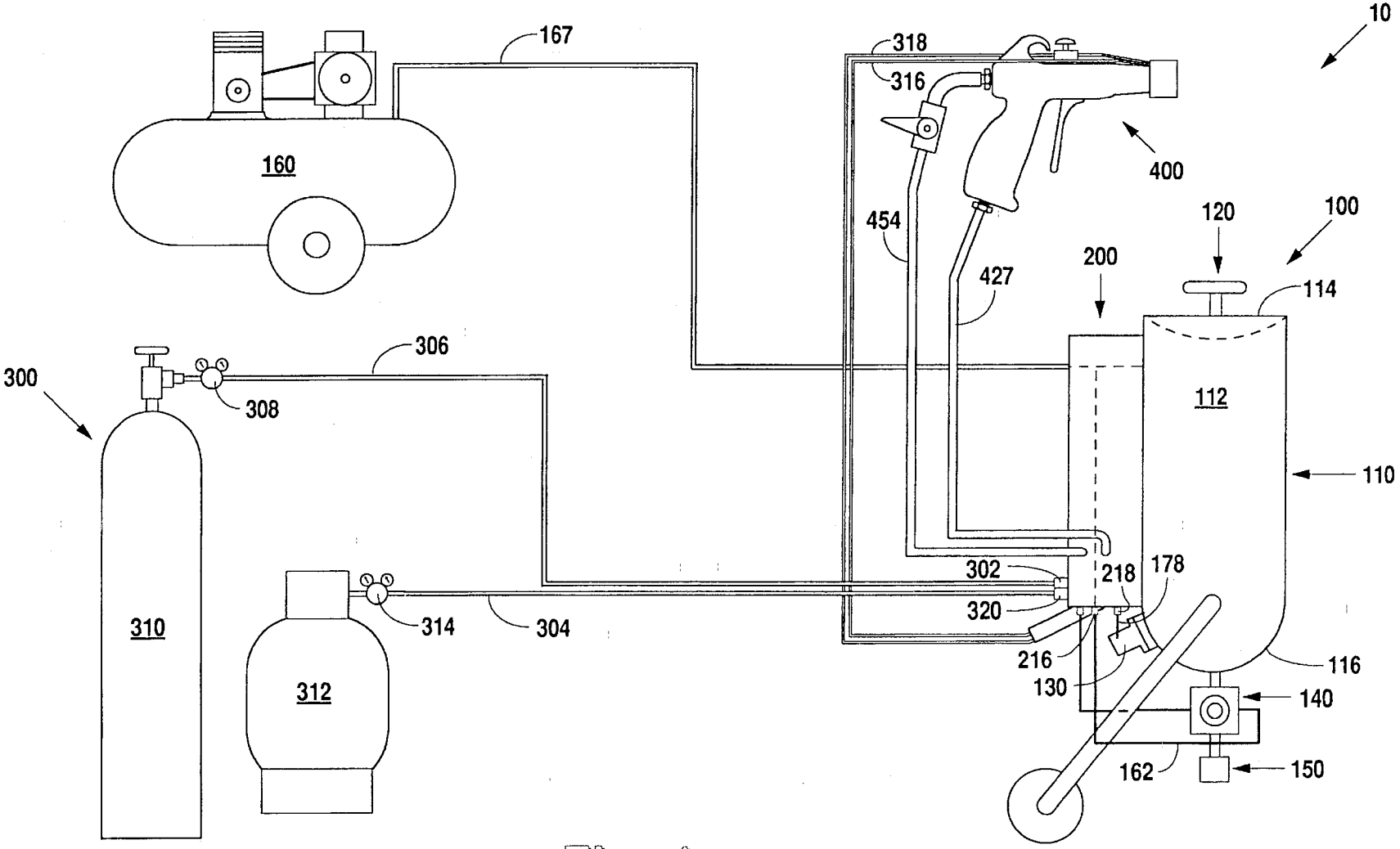
FIG.1 is a schematic view of the preferred embodiment of the Flame Spray System (10).

Referring to FIG. 1, Flame Spray System (10) is comprised of interconnected powder generation system (100), gas supply system (300), and spray gun (400) with centrally located controls housed by control box (200).

Powder generation system (100) is comprised of powder hopper system (110) and air compressor (160). Powder hopper system (110) is comprised of barrel shaped hopper body (112) with concave upper end (114)and convex lower end (116), powder fill valve system (120) corresponding with concave upper end (114) of barrel shaped hopper body (112), powder hopper vibrator (130) and powder metering system (140) communicating with convex lower end (116) of barrel shaped hopper body (112) and powder clean-out system (150) communicating with power metering system (140).

Figure 3A:
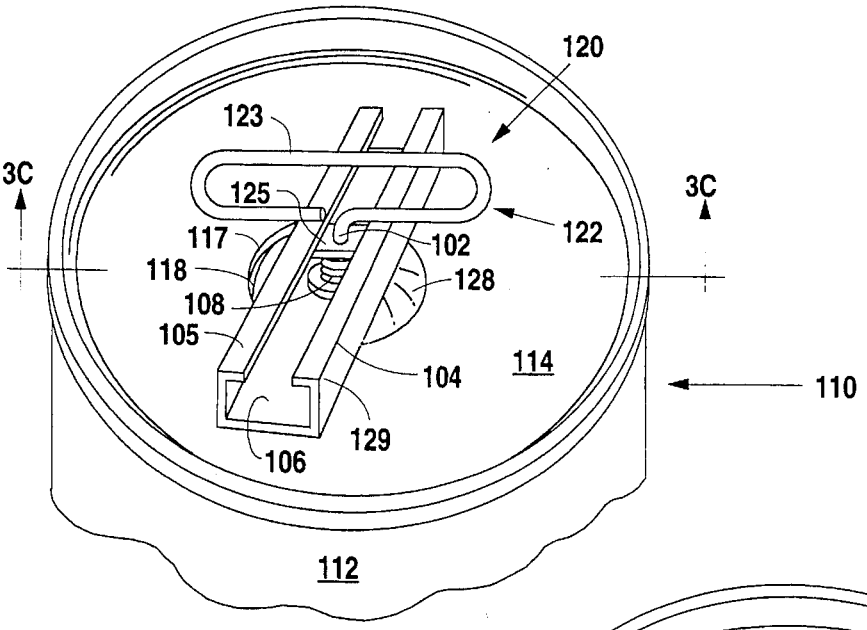
FIG. 3A is a perspective/top view of powder fill valve system (120) in the open position.
Figure 3B:
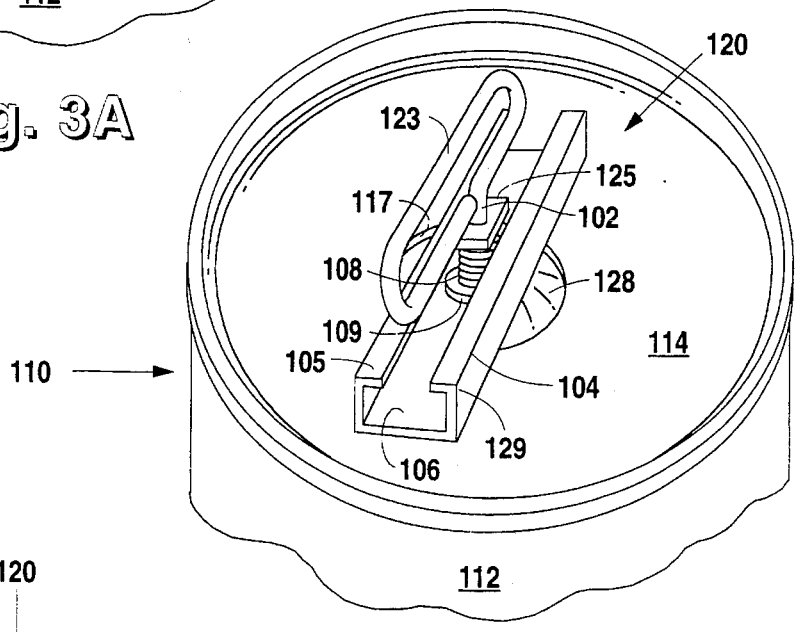
FIG. 3B a perspective/top view of powder fill valve system (120) in the closed position.
Figure 3C:
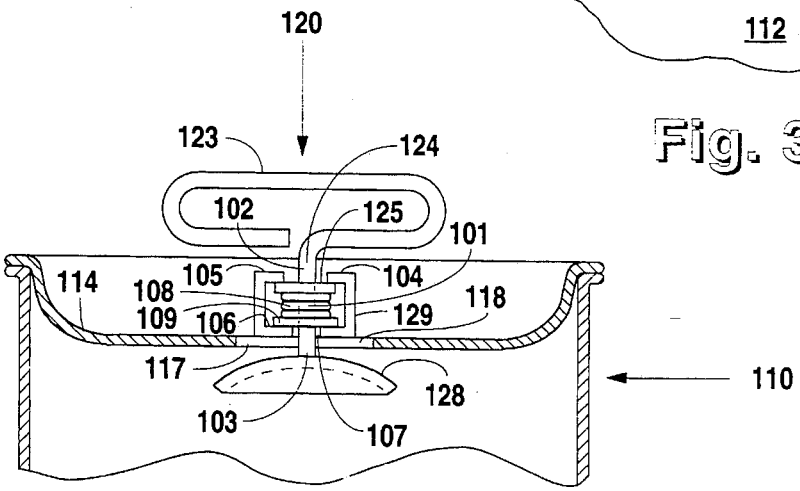
FIG. 3C is a cut away view of powder fill valve system (120) in the open position.

Referring to FIGS. 3A, 3B and 3C powder fill valve system (120) is comprised of handle (122), restraining member (129), circular orifice (118) with interior side (117) in concave upper end (114) of barrel shaped hopper body (112), and dome shaped lid (128). Restraining member (129) is comprised of first lipped side (104), second lipped side (105) connected by bottom side (106) having orifice (107). Handle (122) is comprised of hand grasping member (123) translating into leg member (124). Leg member (124) is comprised of first end (102) proximate to hand grasping member (123), midsection (101), and second end (103) passing through orifice (107) of bottom side (106) of restraining member (129) and fixedly attached to dome shaped lid (128). Engaging platform (125) is fixedly attached approximately to first end (102) of leg member (124). Spring (108) and washer (109) encircle midsection (101) of leg member (124). Washer (109) is positioned below spring (108) and spring (108) is positioned below engaging platform (125) creating a spring load mechanism for maintaining dome shaped lid (128) in an open or closed position.

To fill barrel shaped hopper body (112) with powder, hand grasping member (123) of handle (122) is turned such that engaging platform (125) is restrained by first lipped side (104) and second lipped side (105). In this position, dome shaped lid (128) is pushed downwards into circular orifice (118) of concave upper end (114) of barrel shaped hopper body (112) such that circular orifice (118) is open to receive powder into barrel shaped hopper body (112). To close circular orifice (118), hand grasping member (123) of handle (122) is turned such that engaging platform (125) is released from first lipped side (104) and second lipped side (105) which allows dome shaped lid (128) to move upwards to a position in direct contact with interior side (117) of circular orifice (118) of concave upper end (114) of barrel shaped hopper body (112) such that circular orifice (118) is closed by dome shaped lid (128).

Referring to FIGS. 4A, 4B, 5A and 5B powder metering system (140) is comprised of valve housing (131) with powder entry hole (132), powder exit hole (133), air entry hole (134), air/powder exit hole (135), and powder adjustment hole (148). Powder passage (137) is comprised of two cylindrical interconnecting tubes, first cylindrical powder tube (175) and second cylindrical powder tube (177), which extend from powder entry hole (132) to powder exit hole (133). First cylindrical powder tube (175) is larger in circumference than second cylindrical powder tube (177). Powder entry end (138) of first cylindrical powder tube (175) is threaded to receive powder connection (141) for connecting barrel shaped hopper body (112) to powder metering system (140). Powder exit end (139) of second cylindrical powder tube (177) is threaded to receive connection (142) for connecting powder drain valve (152) of powder clean-out system (150) to power metering system (140).

Air passage (143) extends from air entry hole (134) to air/powder exit hole (135). Air passage (143) is threaded on air entry end (168) for receiving air connector (144). Air connector (144) is attached to pressurized air supply hose (162). Air passage (143) is threaded on air/powder exit end (170) for receiving connector (164). Connector (164) is attached to air/powder hose (166).

Air passage (143) and powder passage (137) are connected via tube (127). Tube (127) is hollow and attached at orifice (179) in first cylindrical powder tube (175) of powder passage (137). Tube (127) intersects air passage (143) at approximately its midpoint point (171). Port (151) of threaded passage (149) also intersects powder passage (137) and tube (127). Port (151) of threaded passage (149) extends into second cylindrical powder tube (177) at orifice ( 181 ) in the upper side section of second cylindrical powder tube (177). Port (151) intersects tube (127) directly below orifice (179).

The amount of powder released from powder passage (137) into air passage (143) via tube (127) is regulated by powder adjustment mechanism (147). Powder adjustment mechanism (147) is comprised of retracting section (119) and sleeve section (121). Retracting section (119) is comprised of adjustment knob (155) attached to retracting member (157). Retracting member (157) is comprised of pressure barrier (113) threaded head (161) and leg member (163). O-ring (115) fits between adjustment knob (155) and pressure barrier (113) to assure powder and pressure does not escape powder metering system (140) through powder adjustment mechanism (147). Sleeve section (121) is comprised of securing sleeve (156) with shoulder section (158) translating into threaded neck section (159), and pressure barrier (165). O-ring (169) fits in grove (183) between threaded neck section (159) and pressure barrier (165) to assure no powder or pressure is released from powder metering system (140) via powder adjustment mechanism (147).

The interior side of securing sleeve (156) is threaded for receiving threaded head (161) of retracting member (157). Port ( 151 ) of threaded passage (149) intersects powder passage (137) and tube (127) as previously described. Securing sleeve (156) is screwed into threaded passage (149) such that leg member (163) projects into port (151). As adjustment knob (155) is turned, threaded head (161) goes further into securing sleeve (156), such that leg member (163) of retracting member (157) projects further into port (151) and accordingly reduces the quantity of powder released into air passage (143) from tube (127) via orifice (179) in first cylindrical powder tube (175) of powder passage (137) and orifice (181) in second cylindrical powder tube (177) of powder passage (137). If additional amounts of powder are required, adjustment knob (155) is turned, unscrewing threaded head (161)of retracting member(157) from securing sleeve (156) which in turn causes leg member (163) to recede from port (151) and accordingly increases the amount of powder released into air passage (143).

If for some reason powder passage (137) or tube (127) becomes clogged, securing sleeve (156) may be removed from threaded passage (149). The debris or blockage is removed and securing sleeve (156) is screwed back into threaded passage (149). By removing securing sleeve (156), the adjustment of threaded head (161) and leg member (163) is retained such that when securing sleeve (156) is screwed back into threaded passage (149), powder metering system (140) does not require readjustment because powder adjustment knob (155) has not been moved relative to securing sleeve (156) during the unclogging process.

Figure 2:
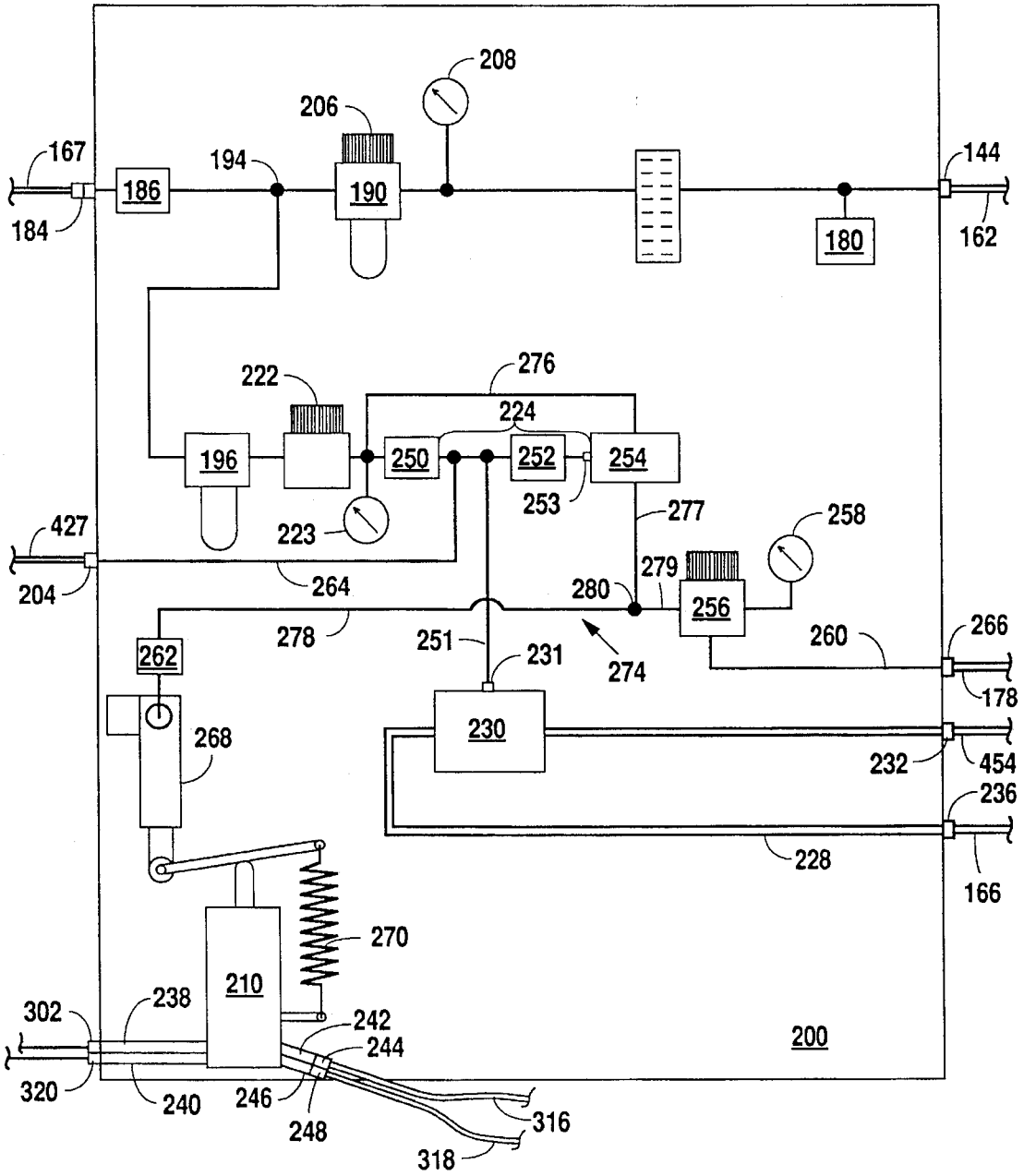
FIG. 2 is a schematic of control housing (200).

The air/powder mixture exits powder metering system (140) through air/powder mixture exit hole (135) and is transported to control housing (200) (FIG. 2) via air/powder mixture hose (166). Referring to FIG. 2, air/powder mixture hose (166) is attached to control housing (200) by air/powder entry port (236). The air/powder mixture travels through control housing (200) via powder/air flow line (228). Powder/air pinch valve (230) is connected to powder/air flow line (228) such that if powder/air pinch valve (230) is closed, the air/powder mixture does not pass powder/air pinch valve (230). If powder/air pinch valve (230) is open, the powder/air mixture passes powder/air pinch valve (230) and passes out of control housing (200) via powder/air exit port (232) into powder hose (454).

Figure 5A:
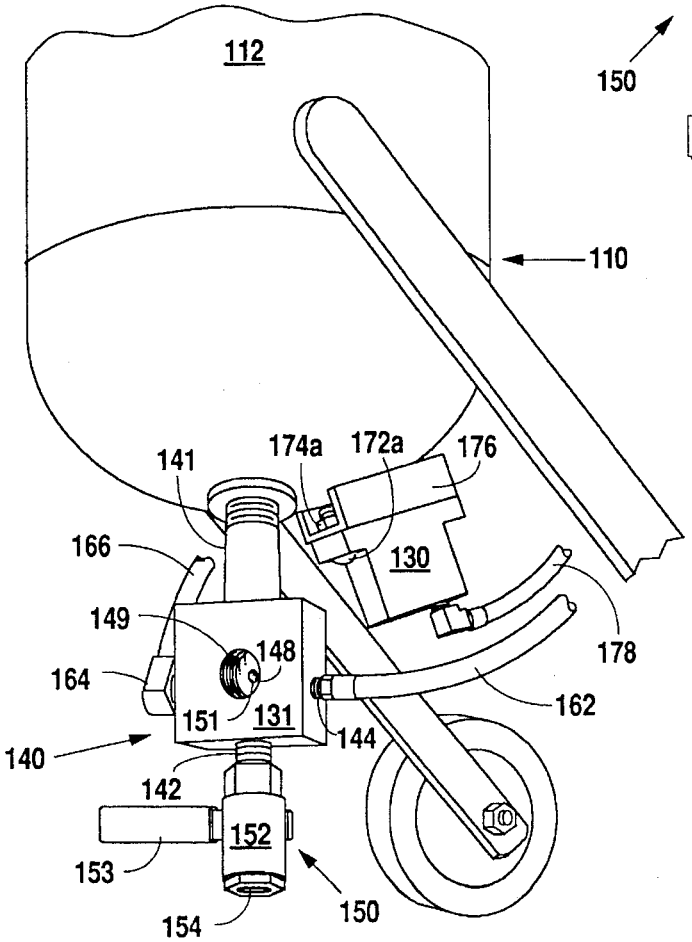
FIG. 5A is a perspective view of powder metering system (140) with powder adjustment mechanism (147) removed.
Figure 5B:
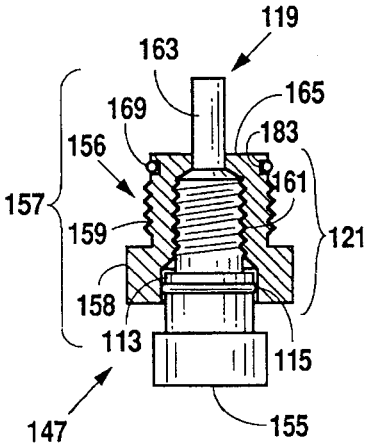
FIG. 5B is a perspective view of powder adjustment mechanism (147).

Referring to FIG. 5A, powder clean-out system (150) is comprised of powder drain valve (152) with powder passage (154), and handle (153) which manually controls powder drain valve (152). After using flame spray system (10), the remaining powder in barrel shaped hopper body (112) is removed by opening powder drain valve (152) by turning handle (153). Powder remaining in powder hopper body (112) drains out of powder hopper system (110) through first cylindrical powder tube (175) and second cylindrical powder tube (177) of powder metering system (140) and powder passage (154) of powder drain valve (152). A blast of air into powder hopper body (112) will dislodge any residual powder in powder hopper body (112), powder metering system (140) or powder clean-out system (150).

Powder hopper vibrator (130) is attached to convex lower end (116) proximate to powder metering system (140). As shown in FIG. 5A, powder hopper vibrator (130) is fixedly attached to convex lower end (116) of barrel shaped hopper body (112) by bolts (172*a–b*) and nuts (174*a–b*) attached to bracket (176). Bolt (172*b*) and nut (174*b*) are not shown. Bracket (176) is fixedly attached to convex lower end (116) of barrel shaped hopper body (112) by soldering, welding or other methods known in the art. Powder hopper vibrator (130) is run by compressed air as discussed below.

Referring to FIG. 1, gas supply system (300) is comprised of oxygen source (310) and propane source (312). Oxygen regulator (308) and propane regulator (314) regulate the flow of gas to control housing (200). Oxygen source (310) is connected to oxygen inlet port (302) on control housing (200) by siamese hose (306). Propane source (312) is connected to propane inlet port (320) by siamese hose (304). Referring to FIG. 2, oxygen inlet port (302)corresponds with deadman control valve (210) in control housing (200) via oxygen entry hose (238). Propane inlet port (320) corresponds with deadman control valve (210) in control housing (200) via propane entry hose (240). If deadman control valve (210) is open, propane proceeds through deadman control valve (210) to propane exit hose (246) to propane exit port (248). Siamese hose (318) connects propane exit port (248) on control housing (200) to manual propane valve (420) via propane connector (418), and oxygen proceeds through deadman control valve (210)to oxygen exit hose (242) to oxygen exit port (244). Siamese hose (316) connects oxygen exit port (244) on control housing (200) to manual oxygen valve (422) on spray gun (400) via oxygen connector (424) (see FIG. 6B).

Referring to FIGS. 6A, 6B, 7 and 7A, spray gun (400) is comprised of gas mixing mechanism (430), oxygen regulation system (414), propane regulation system (416) attached to shaft section (408) of spray gun (400), and powder/air regulation system (412) and control system (426) attached to handle (406) of spray gun (400).

Oxygen regulation system (414) is fixedly attached to shaft section (408) of spray gun (400) by bracket (488). Propane regulation system (416) is fixedly attached to shaft section (408) of spray gun (400) by bracket (487). Powder/air regulation system (412) is attached to handle (406) by L-shaped bracket (480) and screw (481).

Powder/air regulation system (412) is comprised of powder ball valve (452) attached to powder hose (454) by connection (455). The powder/air mixture is transported from control housing (200) through powder hose (454) to powder ball valve (452). As shown in FIG. 6B, powder ball valve (452) is open. If powder ball valve (452) is open, the powder/air mixture will proceed through powder ball valve (452) and into plastic hose (476) via connection (453). Plastic hose (476) has first end (475) and second end (477). Second end (477) is attached to entry end (467) of powder nozzle (466). Powder nozzle (466) extends through shaft section (408) of spray gun (400). Dependent upon the type of powder used, and the amount of heat required to melt the powder exit end (465) of powder nozzle (466) may be adjusted to terminate in any position relative to raised section (464) of nozzle plate (436). In most instances, the preferred position of exit end (465) of powder nozzle (466) is a position slightly recessed in raised section (464) of nozzle plate (436). In this position, powder does not melt within and clog exit end (465) of powder nozzle (466), but rather melts as it travels past the Flame created by the propane/oxygen mixture released from gas nozzles (462*a–l*) on nozzle plate (436). The position of powder nozzle (466) is adjusted by unscrewing nut (402), positioning exit end (465) of powder nozzle (466) in the desired position relative to nozzle plate (436), and refastening nut (402) to secure powder nozzle (466) in position. When powder ball valve (452) is open, powder and air are forced through plastic hose (476) into powder nozzle (466) and out through exit end (465) of powder nozzle (466).

Figure 6A:
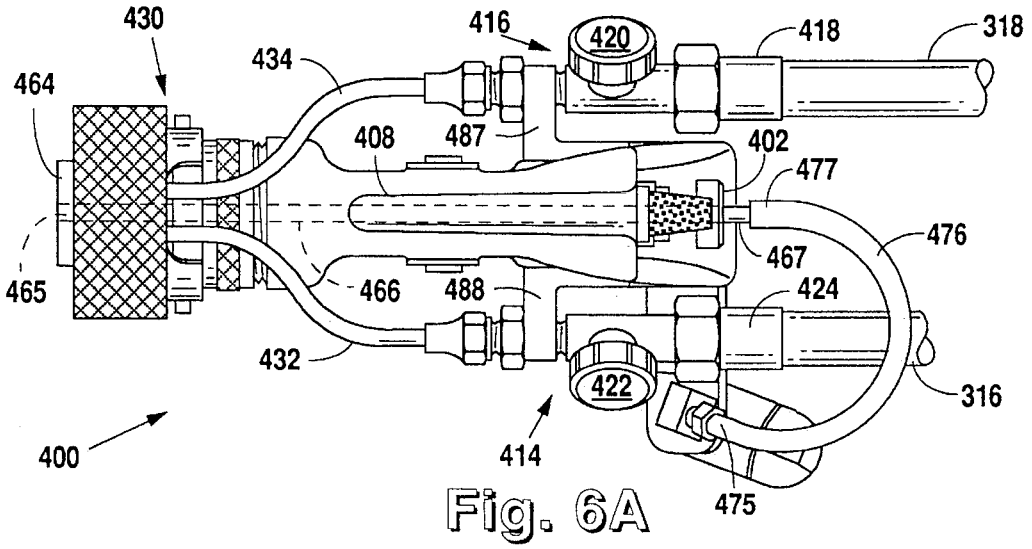
FIG. 6A is a top view of spray gun (400).
Figure 6B:
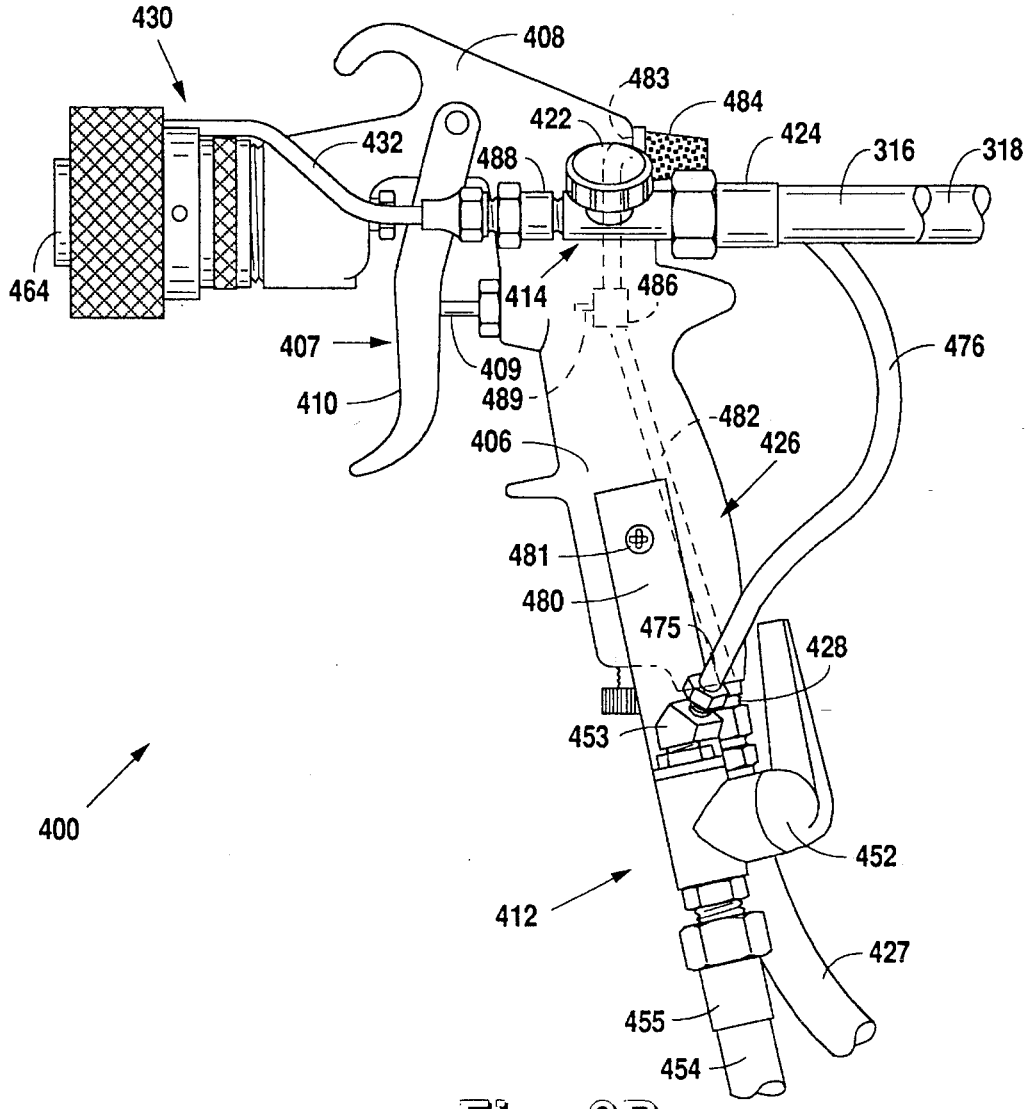
FIG. 6B is a side view of spray gun (400).
Figure 7:
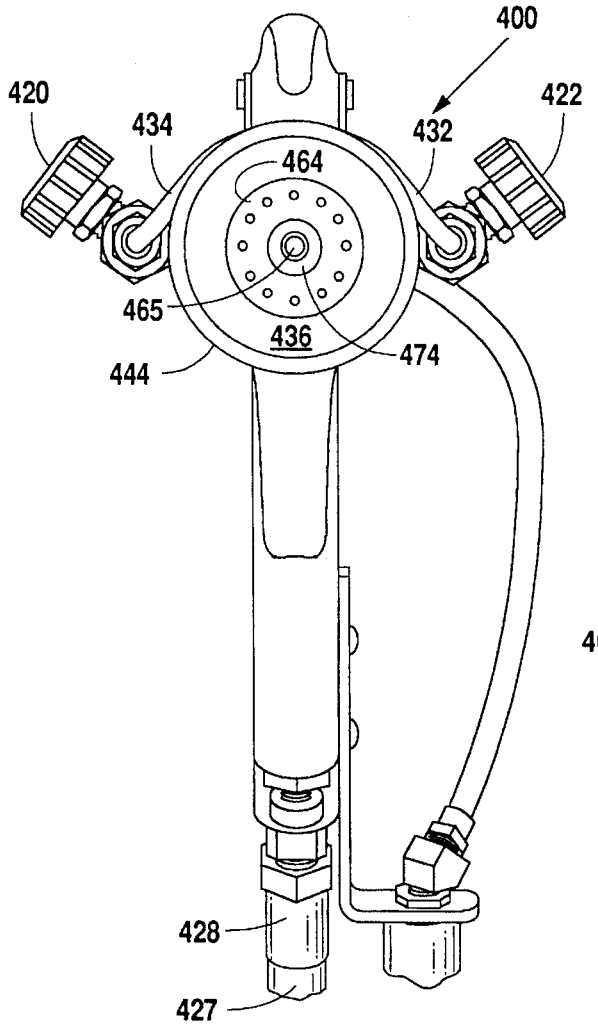
FIG. 7 is a frontal view of spray gun (400).
Figure 7A:
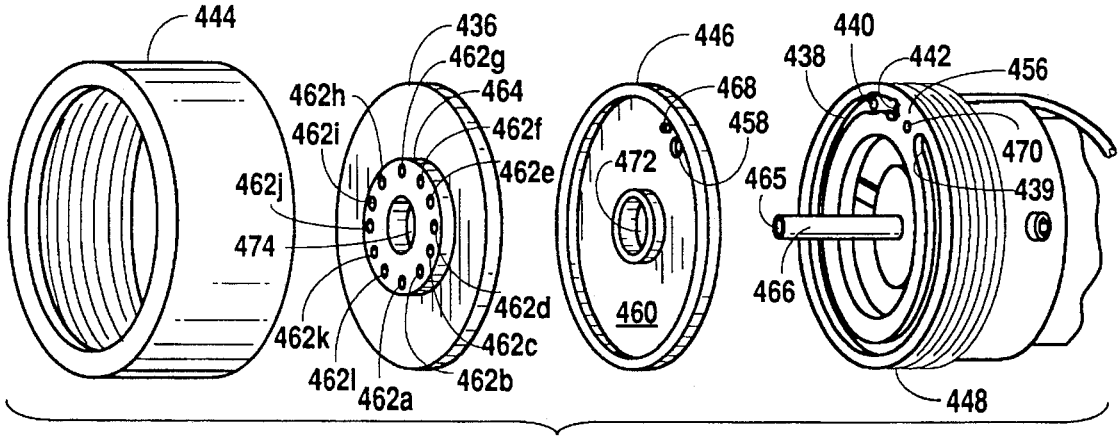
FIG. 7A is a perspective view of spray gun (400) with threaded jacket (444), nozzle plate (436), and burner orifice plate (446) separated from threaded groove plate (448).

Referring to FIGS. 6A, 6B and 7A, oxygen and propane are not mixed until they reach gas mixing mechanism (430) of spray gun (400). Manual propane valve (420) and manual oxygen valve (422) on spray gun (400) allow adjustment of the mixture of gases and consequently the flame heat and size by the user. Gas mixing mechanism (430) comprises oxygen feed line (432) and propane feed line (434), threaded groove plate (448), burner orifice plate (446), nozzle plate (436) and threaded jacket (444). Recessed in front side (456) of threaded groove plate (448) is gas mixing groove (438). Propane feed line (434) and oxygen feed line (432) feed the respective gas into gas mixing groove (438) through propane inlet port (440) and oxygen inlet port (442). The gases mix as they travel approximately 345 degrees around gas mixing groove (438) to terminal end (439) of gas mixing groove (438). The mixed gases proceed through burner orifice (458) in burner office plate (446). The mixture of gases accumulates in gas chamber (460) of burner orifice plate (446) until sufficient gas pressure accumulates such that the gas mixture is forced through gas nozzles (462*a*–462*l*) in raised section (464) of nozzle plate (436). Any Flint lighter may be used to ignite the gas mixture coming out of gas nozzles (462*a*–462*l*) such that the gas mixture is burned producing a flame that causes the powdered plastic exiting out of powder nozzle (466) to melt.

Burner orifice plate (446) is maintained in a position abutting front side (456) of threaded grooved plate (448) such that burner orifice (458) corresponds with terminal end (439) of gas mixing groove (438). This position is maintained by peg (468) fixedly attached to burner orifice plate (446) being inserted into orifice (470) on front side (456) of threaded groove plate (448). Threaded sleeve (444) maintains nozzle plate (436), burner orifice plate (446) and threaded groove plate (448) in close relationship such that no gas leaks out of gas mixing mechanism (430) at a point other than gas nozzles (462*a–l*).

Figure 8:
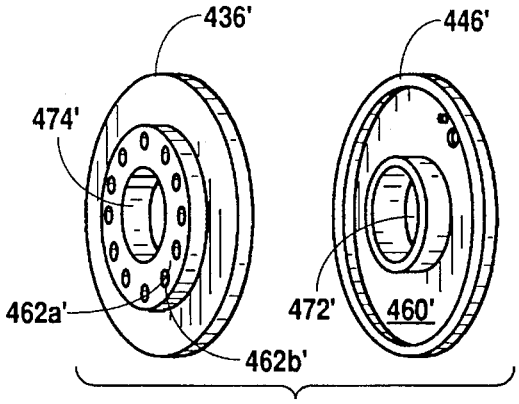
FIG. 8 is a perspective view of alternative nozzle plate (436') and burner orifice plate (446').

Referring to FIG. 8, alternative embodiment of burner orifice plate (446') and nozzle plate (436') are shown. As illustrated, gas chamber (460') is narrower with powder nozzle passage (472') being wider than powder nozzle passage (472) shown in FIG. 7A. Powder nozzle passage (474') is also larger than powder nozzle passage (474) shown in FIG. 7A. Finally, gas nozzles (462*a'–l'*) are also further apart and larger than gas nozzles (462*a–l*) shown in FIG. 7A. The configuration shown in FIG. 8 causes the flame to be further away from powder nozzle (466). The availability of wider circumferences for powder nozzle passages (472') and (474') along with larger gas nozzles (462*a'–l'*) allows applicant's invention to be used for different size meshes and types of powder, provides differing gas mixtures to feed the flame, and allows the user to create a larger pattern of application. Although not wanting to be bound by one theory, applicant believes the change in circumference of powder nozzle passage (472'and 474') allows more air to surround powder nozzle (466). Thus, the Venturi Effect in combination with gas mixing mechanism (430) achieves the proper melting temperature of the powder. For example, if the flame is too hot, the circumference of powder nozzle passage (474) may be increased to allow additional air to pass through powder nozzle passage (472'and 474') such that the amount of heat is reduced and the powder is not burned. The air coming through powder nozzle passages (472 and 474) also carries the powder to the area of application.

Referring to FIGS. 6A, 6B, 7 and 7A, spray gun (400) is made of aluminum with manual oxygen valve (422), manual propane valve (420), threaded jacket (444), nozzle plate (436), burner orifice plate (446), threaded groove plate (448), gas shut-off port (428) and connection (453) being made of brass or other material with similar qualities. Oxygen feed line (432) and propane feed line (434) are made of copper. Powder nozzle (466) is made of brass or other materials with similar quail tics which assure powder does not melt while it is passing through shaft section (408) of spray gun (400).

Control system (426) controls the release of gas and the air/powder mixture trough spray gun (400). Control system (426) is comprised of hose (427) connected from port (204) on control housing (200) (see FIG. 2) and attached to control port (428) on handle (406) of spray gun (400), air channel (482), air release line (483), poppet valve (486) connecting air release line (483) and air channel (482), and trigger system (407). Air release line (483) corresponds with muffler (484). Trigger system (407) is comprised of spring loaded leg member (409) and finger mount (410). When finger mount (410) is squeezed toward handle (406) of spray gun (400), spring loaded leg member (409) is compressed against peg (489) of poppet valve (486), which causes poppet valve (486) to open allowing pressurized air in air channel (482) to be released into air release line (483) and out flame spray system (10) via muffler (484). When finger mount (410) is released, peg (489) of poppet valve (486) is released, closing poppet valve (486) and causing pressurized air to be retained in air channel (482) and not released into air release line (483).

Figure 9:
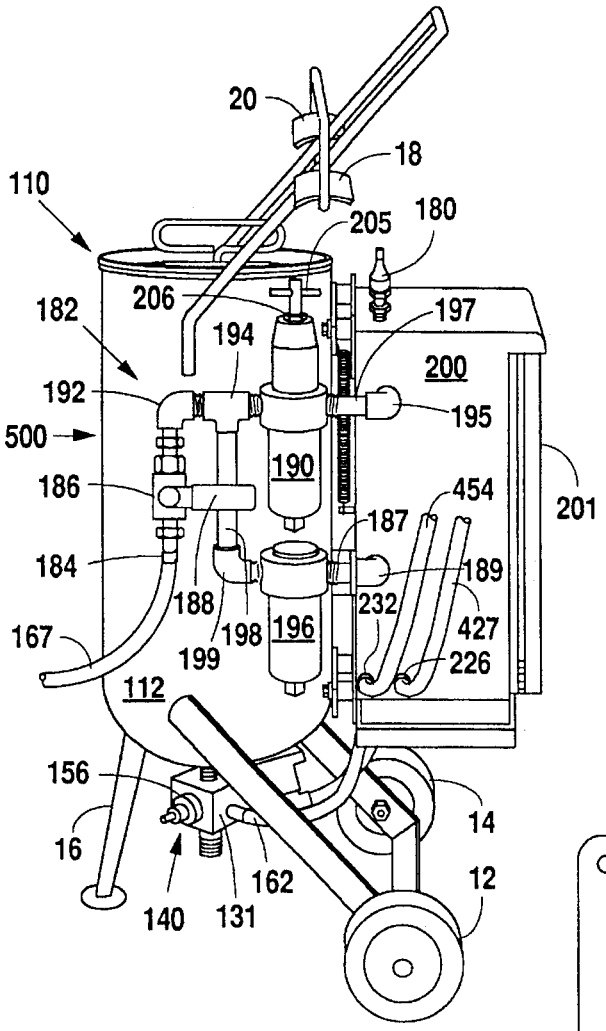
FIG. 9 is a perspective view of the air filtering system (500) attached to control housing (200).

Referring to FIGS. 1 and 9, air entering flame spray system (10) from air compressor (160) is forced through air filtering system (182) to assure that foreign particles are removed from the air before it is mixed with the powder. An air dryer (not shown) may be incorporated between air compressor (160) and air filtering system (182) if excess moisture is present. Air filtering system (182) is comprised of inlet port (184) corresponding with pressurized air supply hose (167) attached to air compressor (160). Valve (186) allows manual control of the flow of air coming from air compressor (160). In FIG. 9, valve (186) is in the off position. To open valve (186), handle (188) is turned 90 degrees downwards. If the valve (186) is open, air proceeds from air compressor (160) through inlet port (184) into air filter (190) and into air filter (196) via elbow connection (192), T-connection (194), connection (198) and elbow (199). The air filters utilized are any common air filters known in the trade. Air from air filter (190) proceeds into control box (200) via connection (197) and elbow (195). Air from air filter (190) ultimately is carried to powder metering system (140). Air from air filter (196) proceeds into control box (200) via connection (187) and elbow (189). This air is ultimately used to power powder hopper vibrator (130) and regulate powder/air pinch valve (230) and deadman control valve (210) (see FIG. 2).

FIG. 2 is a schematic of control housing (200) including air filter (190) and air filter (196). When flame spray system (10) is in use, compressed air enters inlet port (184) communicating with pressurized air supply hose (167), valve (186) allows manual off/on control. At T-connector (194), air is split to air filters (190) and (196). The air going through air filter (190) ultimately proceeds to pressurized air supply hose (162) and into powder metering system (140). In use regulator (206) is adjusted such that gage (208) reads approximately 12 psi of pressure. When powder ball valve (452) on spray gun (400) is open, flow meter (209) should read approximately 100 CFH if regulator (206) is adjusted properly. If the pressure exceeds 12 psi, it can be reduced by using purge (180).

The portion of compressed air filtered through air filter (196) is regulated by control regulator (222). Control regulator (222) is normally adjusted to 50–60 psi, the preselected control pressure as shown on control gage (223). When finger mount (410) of spray gun (400) is in the released position, control regulator (222) maintains the preselected control pressure through flow line (276) and pressure line (224) located between one-way bleed rate valve (250) and control port (253) of shuttle valve (252). One way bleed rate valve (250) restricts the amount of air flowing to pressure line (224) such that when finger mount (410) of spray gun (400) is squeezed, a reduction of pressure occurs across pressure line (224). Bleed rate valve (252) is optional. It is used to damp the resonance and noise caused by pressure against control port (253) of shuttle valve (254). Pressure line (224) is interconnected to control pressure line (264) and pinch valve pressure line (251) such that when pressure is released through control pressure line (264) by opening poppet valve (486), the pressure across pressure line (224) and pinch valve pressure line (251) is reduced by air from pressure line (224) and pinch valve pressure line (251) escaping through control pressure line (264). When the preselected control pressure is reached in pressure line (224) and against control port (253) of shuttle valve (254), shuttle valve (254) is closed. In the closed position, shuttle valve (254) docs not allow air from flow line (276) to proceed to vibrator (130) through air line (274) or to single acting cylinder (268) through air line (274) which keeps deadman control valve (210) in the closed position. When pinch valve pressure line (251) is pressured to the preselected control pressure, powder/air pinch valve (230) is closed, pinching off powder/air flow line (228), thus restricting the flow of the powder/air mixture to spray gun (400).

Air line (274) has a common juncture (280) which creates a first leg (277), second leg (279), and third leg (278). One end of third leg (278) is connected to rate control bleed rate valve (262) and the other end of third leg (278) is connected to common juncture (280). One end of second leg (279) is connected to common juncture (280) and the other end of second leg (279) is connected to vibrator regulator (256). One end of first leg (277) is connected to shuttle valve (254) and the other end of first leg (277) of air line (274) is attached to common juncture (280).

When finger mount (410) of spray gun (400) is squeezed towards handle (406) of spray gun (400), spring loaded leg member (409) engages peg (489) of poppet valve (486) which causes poppet valve (486) to open releasing pressurized air from air channel (482) into air release line (483) and out muffler (484) (see FIG. 6B). Air channel (482) is connected to control pressure line (264) by hose (427). By releasing air from air channel (482), the pressure maintained in control pressure line (264) is also released, which drops the pressure across pressure line (224). As discussed above, pinch valve pressure line (251) is connected to pressure line (224) and, consequently, when pressure across pressure line (224) is reduced, pressure across pinch valve pressure line (251) is also reduced. This reduction in pressure across pinch valve pressure (251) opens pinch valve (230) which allows powder/air mixture to flow out of powder/air exit port (232) and into powder hose (454) to spray gun (400). The reduction in pressure across pressure line (224) causes pressure on control port (253) of shuttle valve (254) to bleed off through bleed rate valve (252) to control pressure line (264). The drop in pressure at control port (253) causes shuttle valve (254) to open and allows air to proceed into air line (274). Some of the air flows into second leg (279) of air line (274) to vibrator regulator (256) as gaged by vibrator gage (258) into vibrator line (260) through vibrator port (266), and into pressurized air supply hose (178) connected to vibrator (130). Vibrator regulator allows less air to pass to vibrator pressure line (260) than is passing through shuttle valve (254). Consequently, the pressure in third leg (278) of air line (274) builds to almost the preselected control pressure. This build up in pressure actuates air operated cylinder (268), raising spring (270) and opening deadman control valve (210), releasing oxygen and propane to spray gun (400).

When finger mount (410) of spray gun (400) is released, peg (489)of poppet valve (486) is disengaged, closing poppet valve (486). At this point, the pressure in pressure line (224), pinch valve pressure line (251), and control pressure line (264) begins to increase because no incoming air from regulator (222) is being released from flame spray system via control pressure line (264). As air bleeds through bleed rate valve (250) from regulator (222), the pressure in control pressure line (264) and pinch valve pressure line (251) builds until it reaches the preselected control pressure (50–60 psi). As control pressure builds at control port (231) of pinch valve (230), pinch valve (230) begins to close, causing flow of powder/air to spray gun (400) to cease. Simultaneously, air is flowing through bleed rate valve (252), building pressure at control port (253) of shuttle valve (254). When control pressure is reached at control port (253) of shuttle valve (254), shuttle valve (254) closes, ceasing air flow from flow line (276) to air line (274).

When shuttle valve (254) closes, the remaining air in air line (274) bleeds off through vibrator regulator (256) and vibrator pressure line (260). As the pressure in air line (274) is reduced, pressure at cylinder (268) is maintained by rate control bleed valve (262). Rate control bleed valve (262) allows the air activating air operated cylinder (268) to bleed off more slowly, thus keeping the flame lit for a few seconds after powder/air stops flowing from spray gun (400) assuring all powder is properly applied. Finally, the pressure in air operated cylinder (268) drops, such that spring (270) closes deadman control valve (210), stopping gas flow to spray gun (400) and causing the flame to be extinguished.

It should be understood that FIG. 2 is only a schematic and does not correctly illustrate where each of the hoses is actually attached to control housing (200). For an accurate illustration of attachment, please see FIG. 1 and FIG. 9.

Figure 10:
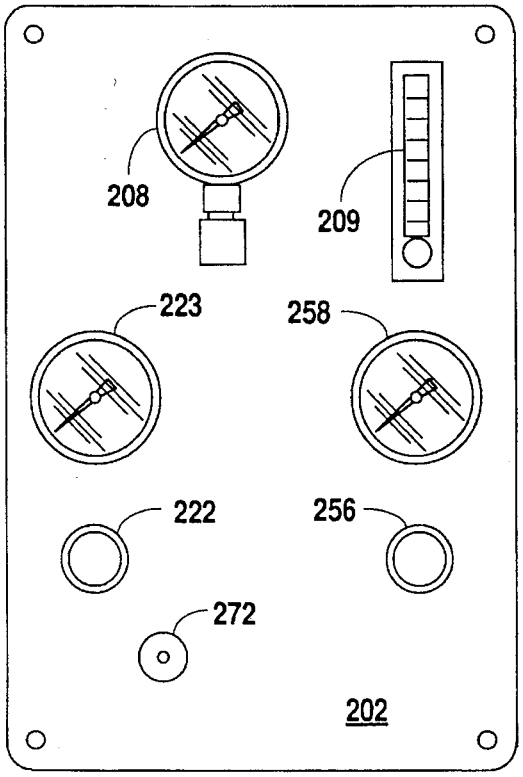
FIG. 10 is a frontal view of control panel (202).

FIG. 10 is an expanded view of control panel (202) illustrating the location of gage (208), flow meter (209), control gage (223), vibrator gage (258), control regulator (222), and vibrator regulator (256). See FIG. 9 for regulator (206).

Also shown on FIG. 10 is flame kill adjustment knob (272). Flame kill adjustment knob (272) controls rate control bleed valve (262) (see FIG. 2). If finger mount (410) does not remain released for a period of time longer than pre-set by the user by flame kill adjustment knob (272), rate control bleed valve (262) allows the air against air operated cylinder (268) to bleed off slowly which assures spring (270) does not close deadman control valve (210). On the other hand, if finger mount (410) is released for a period of time longer than the pre-set time as selected by the user by adjusting flame kill adjustment knob (272), the pressure in air operated cylinder (268) all bleeds into air line (274), allowing spring (270) to close deadman control valve (210). Flame kill adjustment knob (272) is both a safety mechanism if the gun is dropped in use and a method of maintaining gas flow to spray gun (400) when finger mount (410) is not squeezed. After a pre-set amount of time, preferably 4–5 seconds as set by flame kill adjustment knob (272), the gas flow will be turned off by deadman control valve (210) closing. Consequently, if the gun is dropped, the flame will turn off after the pre-set time period avoiding hazardous situations. Yet, rate control bleed valve (262) also assures that each time finger mount (410) is released, the flame does not go out. For example, in use, the user will squeeze finger mount (410) and powder and air will be released through powder nozzle (466). When finger mount (410) is released, as the user pulls the gun back to its starting position, powder and air is not released from powder nozzle (466) of spray gun (400), but the flame continues unless finger mount (410) is not squeezed for the pre-set period of time. Otherwise, each time the user releases finger mount (410), the flame would go out, which would be both time consuming and unnecessary unless spray gun (400) were dropped or the user wanted to stop spraying.

Referring to FIG. 1, to use flame spray system (10), turn on air compressor (160) before connecting it to flame spray system (10) to assure it is in working order. Attach an air blow gun (not shown) to air hose (167) From air compressor (160) and blow all debris from powder generation system (100), paying particular attention to concave upper end (114) of barrel shaped hopper body (112) to assure debris does not enter barrel shaped hopper body (112) via powder fill valve system (120). Extreme care should be exercised when powder hopper body (112) has been opened. The blow gun should be used every time, prior to opening powder hopper body (112), to remove all debris from concave upper end (114)of barrel shaped hopper body (112). Referring to FIG. 9, close valve (186) and connect air hose (167) to inlet port (184) of air filtering system (182). Check powder clean-out system(150) to assure powder drain valve (152) is closed (see FIG. 4A). Referring to FIGS. 3A–3C, fill barrel shaped hopper body (112) with the selected powder by turning hand-grasping member (123) of handle (122) such that platform (125) is restrained by first lip side (104) and second lip side (105) of restraining member (129). This causes dome-shaped lid (128) to be pushed downwards into circular orifice (118) of concave upper end (114) of barrel-shaped hopper body (112) such that circular orifice (118) is open for receiving powder into barrel-shaped hopper body (112). Tap, blow or brush excess powder into barrel-shaped hopper body (112). Once barrel-shaped hopper body (112) is filled with the sufficient quantity of powder, circular orifice (118) is closed by turning hand-grasping member (123) of handle (122) such that engaging platform (125) is released from first lip side (104) and second lip side (105) of restraining member (129).

Referring to FIG. 9, after filling and closing barrel-shaped hopper body (112), check to assure control shaft (205) of regulator (206) is backed off; i.e. loose. Valve (186) of air filtering system (182) is then opened by turning handle (188) 90 degrees downwards from its closed position to its open position.

Referring to FIGS. 2 and 10, control regulator (222) is adjusted to show 50–60 psi of pressure, the preselected control pressure, on control gage (223). Referring to FIG. 6B, powder ball valve (452) on spray gun (400) is closed and finger mount (410) is squeezed. By squeezing finger mount (410) pressure is released from pressure line (224) via control pressure line (264) which allows shuttle valve (254) to open, allowing air to vibrator regulator (256) and ultimately to vibrator (130) (see FIG. 2). Vibrator regulator (256)should be adjusted to read approximately 5–6 psi. This adjustment being reflected in vibrator gage (258) (see FIG. 10).

Referring to FIGS. 4A, 4B, 5A and 5C, adjustment knob (155) is turned such that powder adjustment mechanism (147) is in the closed position; i.e., leg member (163) is extended past orifice (179) of cylindrical powder tube (175) and into orifice (181) in cylindrical powder tube (177), completely shutting off powder flow into tube (127). Control shaft (205) of regulator (206) is turned to increase the pressure in barrel shaped hopper body (112) to 12 psi, as reflected on gage (208) (see FIGS. 9 and 10). Referring to FIG. 6B, open powder ball valve (452) on spray gun (400). Readjust regulator (206) by turning control shaft (205) to establish flow on flow meter (209) to approximately 100 CFH. Flow meter (209) should be read at the center of the float ball (see FIG. 10). This range of flow rate has been found to be the most effective. Of course, depending on the type or weight of the powder, this may need to be changed accordingly.

Figure 4A:
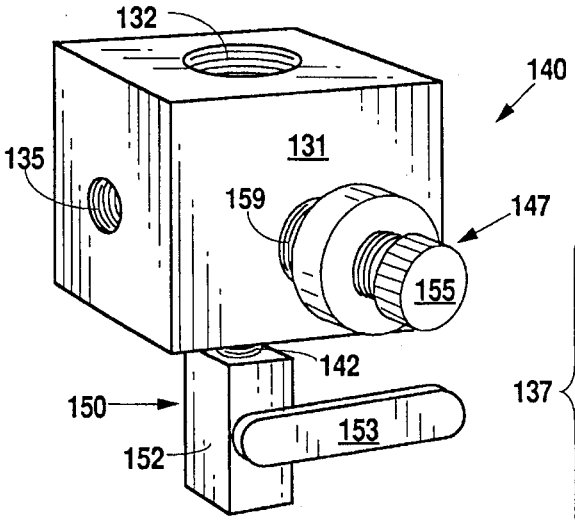
FIG. 4A is a perspective view of the powder metering system (140) and powder clean-out system (150).
Figure 4B:
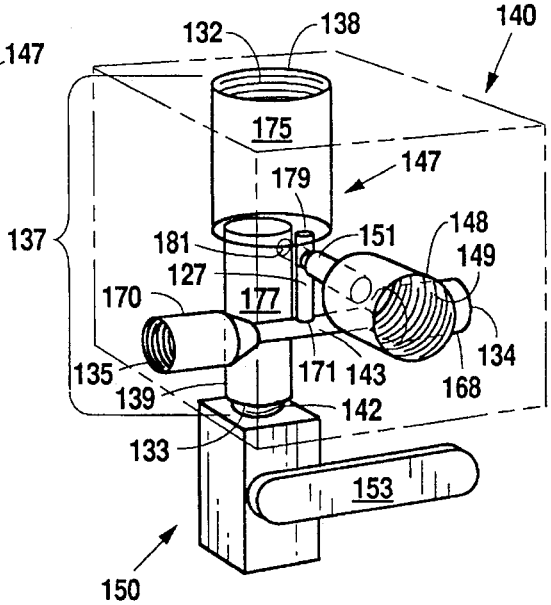
FIG. 4B is a cut away view of valve housing (131).

Referring to FIGS. 4A and 6B, turn adjustment knob (155) approximately one turn counter-clockwise. Squeeze finger mount (410). Adjust the powder/air mixture flow through spray gun (400) to the desired level by turning adjustment knob (155) while squeezing finger mount (410). After the powder/air mixture flow has been adjusted to the desired level, release finger mount (410) and close powder ball valve (452) on spray gun (400).

Referring to FIGS. 1, 6A and 6B, open oxygen source (310) and propane source (312) to check for leaks from oxygen regulator (308), propane regulator (314) or any of the numerous connections relevant to the flow of oxygen and propane. Check to assure powder ball valve (452) is closed. Squeeze finger mount (410) on spray gun (400), then open manual propane valve (420) to purge air from siamese hose (318). Adjust propane regulator (314) to 10 psi. Close manual propane valve (420) and release finger mount (410). Repeat the same procedure to purge siamese hose (316) attached to manual oxygen valve (422). Set oxygen regulator (308) to 25 psi.

To light flame spray system (10), squeeze finger mount (410) on spray gun (400) and open manual propane valve (420). This forces gas into gas mixing mechanism (430) and out gas nozzles (462*a–l*) on nozzle plate (436). Light the gas coming out of gas nozzles (462*a–l*) with a welders lighter or other flint lighter. Adjust the flame using manual propane valve (420). Open manual oxygen valve (422) and continue adjusting flame using manual oxygen valve (422), so that the inner cone of the flames are about ½ inch to 1 inch long, depending on the type of powder and nozzle plate (436) being utilized. Inspect gas mixing mechanism (430) to ensure that no gas is leaking in unwanted areas causing spurious flames. Open powder ball valve (452) on spray gun (400) and begin spraying by squeezing and releasing finger mount (410).

Referring to FIG. 9, if powder stops feeding while spraying, valve (186) should be closed. Pressure in powder hopper system (110) is released by pulling purge (180). After the hopper pressure has been released, position a catch tray under powder cleanout system (150). Open powder drain valve (152) so that powder may be released from powder hopper body (112) through powder passage (137) of powder metering system (140) and out powder passage (154) of powder cleanout system (150). If only one cup of material drains out of barrel shaped hopper body (112), barrel shaped hopper body is empty. If the job is not complete, barrel shaped hopper body (112) should be refilled and the previous sequence followed to start up flame spray system (10) to complete the job.

If it is determined that barrel shaped hopper body (112) is still full of powder, powder metering system (140) is probably clogged. As a second check, use purge (180) to release any remaining pressure in powder hopper system (110). Carefully lay barrel shaped hopper body (112) on front side (201) of control housing (200) such that powder metering system (140) is accessible (see FIG. 9).

Unscrew securing sleeve (156) from housing (131) of powder metering system (140). Using a blow gun attached to air compressor (160), blow air into threaded passage (149) and port (151) (see FIGS. 4B and 5A). After all powder is removed from threaded passage (149) and port (151), reinstall securing sleeve (156) into threaded passage (149). When doing this step, if adjustment knob (155) is not turned in relation to securing sleeve (156) when securing sleeve (156) is removed from threaded passage (149), the previously set flow rate will be retained when securing sleeve (156) is replaced in threaded passage (149), thus retaining the previously set flow rate of powder.

After replacing securing sleeve (156) into housing (131) of powder metering system (140), return flame spray system (10) to its upright position on wheels (12 and 14) and peg stand (16) (see FIG. 9). Start up flame spray system (10) as previously described, and resume spraying.

To shut down flame spray system (10) after the job is complete, turn off oxygen source (310) and propane source (312) (see FIG. 1). Turn adjustment knob (155) of powder metering system (140) such that no powder is released from powder passage (137) into air passage (143).

Referring to FIGS. 6A and 6B, open manual oxygen valve (422) and manual propane valve (420) on spray gun (400). Close powder ball valve (452) on spray gun (400). Squeeze finger mount (410) to bleed off the remaining propane and oxygen in gas mixing mechanism (430), oxygen feed line (432), propane feed line (434) and siamese hoses (316 and 318).

Referring to FIG. 9, close valve (186) stopping all air flow from air compressor (160) to flame spray system (10). Remove air hose (167) from inlet port (184). Attach a blow gun to air hose (167) and clean any debris from concave upper end (114) of barrel shaped hopper body (112). Release air pressure in powder hopper system (110) by unscrewing control shaft (205) on regulator (206) followed by pulling purge (180).

After the pressure has been bled from barrel shaped hopper body (112), and powder metering system (140), position a catch pan under powder cleanout system (150) and open powder drain valve (152) such that all powder drains from barrel shaped hopper body (112) through powder passage (137) of powder metering system (140), and through powder passage (154) of powder cleanout system (150).

Referring to FIG. 1, disconnect siamese hose (304) from propane inlet port (320) and siamese hose (306) from oxygen inlet port (302). Disconnect hose (427) and powder hose (454) from spray gun (400), and siamese hose (318) and siamese hose (316) from spray gun (400). Roll hoses and store on hose hooks (18 and 20) (see FIG. 9). Cover flame spray system (10), not including air compressor (150), oxygen source (310) and propane source (312), to prevent debris from accumulating on concave upper end (114) of barrel shaped hopper body (112).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A spray gun for applying thermoplastic powdered material onto surfaces by passing said thermoplastic powdered material through a flame, comprising:

a shaft section;

a handle section fixedly attached to said shaft section;

a trigger system for controlling the release of said thermoplastic powdered material and gases for fueling said flame, said trigger system adjacent the intersection of said shaft section and said handle section;

a gas control mechanism attached to said shaft section of said spray gun;

a gas mixing mechanism contiguous to said shaft section distal from said intersection of said shaft section and said handle section;

a powder nozzle interposed in said shaft section of said gun, having a first end and a second end, said first end proximate to said gas mixing mechanism, said second end attached to a powder/air regulation system; and a control system communicating with said trigger system.

2. The apparatus of claim 1 wherein said powder nozzle is manually adjustable for changing said first end's position in relationship to said gas mixing mechanism.

3. The apparatus of claim 1 wherein said gas mixing mechanism is further comprised of:

a threaded groove plate fixedly attached to said shaft section at said distal point from said intersection of said shaft section and said handle section;

a burner orifice plate having a forward face and a rear face, said rear face engaging said threaded groove plate;

a nozzle plate having a forward face and a rear face, said rear face of said nozzle plate abutting said forward face of said burner orifice plate;

a threaded jacket which engages said threaded groove plate for maintaining said burner orifice plate engaged to said threaded groove plate and said nozzle plate abutting said burner orifice plate such that gas does not leak from between said threaded groove plate and said burner orifice plate and said burner orifice plate and said nozzle plate; and a powder nozzle bore through the center of said threaded groove plate, said burner orifice plate and said nozzle plate for receiving said first end of said powder nozzle.

4. The apparatus of claim 3 wherein said threaded groove plate has a gas mixing groove concentric to and recessed in said threaded groove plate, said gas mixing groove having a starting end and a terminal end.

5. The apparatus of claim 4 wherein said starting end and said terminal end of said gas mixing groove are about 340 to about 350 degrees apart.

6. The apparatus of claim 4 wherein said threaded groove plate has a first gas port and a second gas port communicating with said gas mixing groove.

7. The apparatus of claim 5 wherein said threaded groove plate has a first gas port communicating with said starting end of said gas mixing groove and a second gas port communicating with said gas mixing groove at a distance proximate to said first gas mixing port.

8. The apparatus of claim 7 wherein said distance between said first gas mixing port and said second gas mixing port is less than 10 degrees.

9. The apparatus of claim 4 wherein said forward face of said burner orifice plate has a recessed gas chamber, said recessed gas chamber having a burner orifice communicating with said terminal end of said gas mixing groove of said threaded groove plate.

10. The apparatus of claim 9 wherein said front face of said nozzle plate has a raised section having a plurality of gas nozzles extending therethrough and communicating with said recessed gas chamber of said burner orifice plate.

11. The apparatus of claim 3 wherein said trigger system is comprised of a finger mount adjacent to a spring loaded leg member, said spring loaded leg member capable of retracting into said handle section of said spray gun;

said control system comprising an air release line and a control pressure line in said handle section of said spray gun, said air release line connected to said control pressure line by a poppet valve; and said poppet valve having a control mechanism activated by retracting said spring loaded leg member of said trigger system by squeezing said finger mount to engage said control mechanism of said poppet valve and open said poppet valve, allowing air from said control pressure line into said air release line.

12. The apparatus of claim 2 wherein said gas mixing mechanism is further comprised of:

a threaded groove plate fixedly attached to said shaft section at said distal point from said intersection of said shaft section and said handle section;

a burner orifice plate having a forward face and a rear face, said rear face engaging said threaded groove plate;

a nozzle plate having a forward face and a rear face, said rear face abutting said forward face of said burner orifice plate;

a threaded jacket which engages said threaded groove plate for maintaining said burner orifice plate engaged to said threaded groove plate and said nozzle plate abutting said burner orifice plate such that gas does not leak from between said threaded groove plate and said burner orifice plate and said burner orifice plate and said nozzle plate; and a powder nozzle bore through the center of said threaded groove plate, said burner orifice plate and said nozzle plate for receiving said first end of said powder nozzle.

13. The apparatus of claim 12 wherein said threaded groove plate has a gas mixing groove concentric to and recessed in said threaded groove plate, said gas mixing groove having a starting end and a terminal end, said starting end and said terminal end being about 340 to 350 degrees apart;

said threaded groove plate having a first gas port communicating with said starting end of said gas mixing groove and a second gas port communicating with said gas mixing groove at a distance proximate to said first gas mixing port, said distance between said first gas mixing port and said second gas mixing port being less than 10 degrees;

said forward face of said burner orifice plate having a recessed gas chamber, said recessed gas chamber having a burner orifice communicating with said terminal end of said gas mixing groove of said threaded groove plate;

said rear face of said burner orifice plate having a peg fixedly attached thereto, and said threaded groove plate having an orifice for receiving said peg fixedly attached to said rear face of said burner orifice plate; and said front face of said nozzle plate having a raised section having a plurality of gas nozzles extending therethrough and communicating with said recessed gas chamber of said burner orifice plate.

14. The apparatus of claim 13 wherein said trigger system is comprised of a finger mount adjacent to a spring loaded leg member, said spring loaded leg member capable of retracting into said handle section of said spray gun;

said control system comprising an air release line and a control pressure line in said handle section of said spray gun, said air release line connected to said control pressure line by a poppet valve;

said poppet valve having a control mechanism activated by retracting said spring loaded leg member of said trigger system, by squeezing said finger mount to engage said control mechanism of said poppet valve and open said poppet valve, allowing air from said control pressure line into said air release line.

15. A flame spray system for applying thermoplastic powdered material onto surfaces, said flame spray system having centrally located controls regulated by a pressurized carrier gas comprising:

a spray gun comprised of a shaft section attached to a handle section;

a trigger system, said trigger system adjacent the intersection of said shaft section and said handle section, said trigger system comprised of a finger mount adjacent a spring loaded leg member, said spring loaded leg member capable of retracting into said handle section of said spray gun;

a first pressurized air line and a second pressurized air line containing said carrier gas;

said first pressurized air line communicating with a powder metering system attached to a hopper for holding powder for release into said first pressurized air line, with the outflow of said powder metering system being transported to said spray gun;

said second pressurized air line communicating with a regulator means then splitting into a flow line and interconnected pressure line, pinch valve pressure line, and control pressure line such that said carrier gas may be bled off from said pinch valve pressure line and said pressure line through said control pressure line;

a one-way rate control valve attached to said pressure line before said connection between said pressure line, said pinch valve pressure line and said control pressure line for restricting the amount of carrier gas flow to said pressure line; and said regulator means being user adjustable for setting a preselected control pressure.

16. The apparatus of claim 15, further comprising:

a pinch valve attached to said outflow from said powder metering system and having a control port communicating with said pinch valve pressure line;

a shuttle valve having an entry port, an exit port, and a control port communicating with said pressure line, said flow line attached to said entry port of said shuttle valve;

said shuttle valve and said pinch valve being housed in a control box distal from said spray gun;

a poppet valve located in said handle section of said spray gun adjacent to said spring loaded leg member of said trigger system, said poppet valve having an entry port and an exit port, said control pressure line attached to said entry port of said poppet valve, said exit port of said poppet valve attached to an air release line for receiving air from said control pressure line when said poppet valve is open; and said poppet valve further comprised of a control mechanism activated by the retraction of said spring loaded leg member of said trigger system such that when said spring loaded leg member is retracted by said finger mount being squeezed, said spring loaded leg member engages said control mechanism of said poppet valve, opening said poppet valve and allowing carrier gas in said control pressure line to flow into said air release line, effecting a drop in pressure in said pressure line and said pinch valve pressure line to a level below said preselected control pressure by allowing said pressure in said pinch valve pressure line and said pressure line to be bled off through said control pressure line; and said drop in pressure in said pressure line effecting a reduction in pressure at said control port of said shuttle valve, opening said shuttle valve, and said drop in pressure in said pinch valve line effecting a reduction in pressure at said control port of said pinch valve, opening said pinch valve.

17. The apparatus of claim 16 further comprising:

an air line having a common juncture creating a first leg, second leg, and third leg;

said first leg of said air line attached to said exit port of said shuttle valve, such that when said shuttle valve is open, carrier gas flows through said shuttle valve into said first leg of said air line to said common juncture;

said second leg of said air line having a first end and a second end, said first end of said second leg of said air line being attached to said common juncture and said second end of said second leg attached to a regulator, said regulator connected to a vibrator line, the end of said vibrator line distal said regulator connected to an air operated vibrator fixedly attached to said hopper proximate to said powder metering system, such that when said shuttle valve is open, carrier gas is transported through said regulator into said vibrator line causing said air operated vibrator to vibrate;

said third leg of said air line having a first end and a second end, said first end of said third leg connected to said common juncture and said second end of said third leg of said air line being connected to a rate control bleed valve, said rate control bleed valve attached to an air operated cylinder attached to a spring attached to a deadman control valve for regulating the flow of flame supply gases to said spray gun, such that when said shuttle valve is open, carrier gas is transported to said air operated cylinder which causes said air operated cylinder to activate said spring which opens said deadman control valve and allows said flame supply gases to be transported to said spray gun; and said pinch valve connected to said outflow of said powder metering system such that when said pinch valve is closed, said outflow is restricted from transport to said spray gun and when said pinch valve is open, said outflow is transported to said spray gun.

18. The apparatus of claim 17 wherein said rate control bleed valve allows said carrier gas activating said air operated cylinder to be bled off more slowly than said control pressure is reached in said interconnected pressure line, said control pressure line and said pinch valve pressure line such that said deadman control valve remains open for a period of time after said shuttle valve and said pinch valve are closed.

19. The apparatus of claim 18 further comprising a flame kill adjustment knob communicating with said rate control bleed valve such that said period of time said deadman control valve remains open after said shuttle valve and said pinch valve close is user adjustable.

20. The apparatus of claim 19 further comprising a carrier gas filtering system communicating with a pressurized air line containing said carrier gas and splitting said pressurized air line into said first pressurized air line and said second pressurized air line.

21. The apparatus of claim 20 further comprising:

an user adjustable regulator attached to said first pressurized air line for adjusting the quantity of carrier gas flowing to said powder metering system through said first pressurized air line;

a purge valve attached to said first pressurized air line after said user adjustable regulator for purging said first pressurized air line; and said regulator attached to said vibrator line being user adjustable for adjusting the quantity of carrier gas flowing to said air controlled vibrator through said vibrator line.

22. The apparatus of claim 15 further comprising a carrier gas filtering system communicating with a pressurized air line containing said carrier gas and splitting said pressurized air line into said first pressurized air line and said second pressurized air line.

23. A flame spray system for applying thermoplastic powdered material onto surfaces by passing said thermoplastic powdered material through a flame, comprising:

a powder generation system comprised of a powder hopper for holding powder and capable of being pressurized and a powder metering system;

a gas supply system for supplying gases to feed said flame;

a centrally located control system regulated by a pressurized carrier gas; and a spray gun, said spray gun further comprising, a shaft section attached to a handle section, a trigger system communicating with said centrally located control system for controlling the release of said thermoplastic powdered material and said gases from said gas supply system, said trigger system adjacent the intersection of said shaft section and said handle section;

a gas control mechanism attached to said shaft section of said spray gun;

a gas mixing mechanism contiguous to said shaft section distal from said intersection of said shaft section and said handle section; and a powder nozzle interposed in said shaft section of said gun, said powder nozzle having a first end and a second end, said second end communicating with said powder generation system.

24. The apparatus of claim 23 wherein said gas mixing mechanism is further comprised of:

a threaded groove plate fixedly attached to said distal point of said shaft section from said intersection of said shaft section and said handle section;

a burner orifice plate having a forward face and a rear face, said rear face engaging said threaded groove plate;

a nozzle plate having a forward face and a rear face, said rear face abutting said forward face of said burner orifice plate;

a threaded jacket which engages said threaded groove plate for maintaining said burner orifice plate engaged to said threaded groove plate and said nozzle plate abutting said burner orifice plate such that gas does not leak from between said threaded groove plate and said burner orifice plate and said burner orifice plate and said nozzle plate; and a powder nozzle bore through the center of said, threaded groove plate, said burner orifice plate and said nozzle plate for receiving said first end of said powder nozzle.

25. The apparatus of claim 24 wherein said threaded groove plate has a gas mixing groove concentric to and recessed in said threaded groove plate, said gas mixing groove having a starting end and a terminal end, said starting end and said terminal end being about 340 to about 350 degrees apart;

said threaded groove plate having a first gas port communicating with said starting end of said gas mixing groove and a second gas port communicating with said gas mixing groove at a distance proximate to said first gas mixing port, said distance between said first gas mixing port and said second gas mixing port being less than 10 degrees;

said forward face of said burner orifice plate having a recessed gas chamber, said recessed gas chamber having a burner orifice communicating with said terminal end of said gas mixing groove of said threaded groove plate;

said rear face of said burner orifice plate having a peg fixedly attached thereto, and said threaded groove plate having an orifice for receiving said peg fixedly attached to said rear face of said burner orifice plate; and said front face of said nozzle plate having a raised section having a plurality of gas nozzles extending therethrough and communicating with said recessed gas chamber of said burner orifice plate.

26. The apparatus of claim 25 wherein said centrally located control system further comprises:

a first pressurized air line and a second pressurized air line;

said first pressurized air line communicating with said powder metering system of said powder generation system, the outflow from said powder generation system being transported to said spray gun;

said second pressurized air line communicating with a regulator means, then splitting into a flow line and interconnected pressure line, pinch valve pressure line, and control pressure line, such that air may be bled from said pinch valve pressure line and said pressure line through said control pressure line;

a one-way rate control valve attached to said pressure line before said connection between said pressure line, said pinch valve pressure line and said control pressure line, for restricting the amount of carrier gas flow to said pressure line;

said regulator means being user adjustable for setting a preselected control pressure;

a pinch valve attached to said outflow from said powder generation system, said pinch valve further comprising a control port communicating with said pinch valve pressure line, such that when said pinch valve is closed, said outflow is restricted from transport to said spray gun, and when said pinch valve is open, said outflow is transported to said spray gun;

a shuttle valve having a control port communicating with said pressure line and an entry port and an exit port, said flow line attached to said entry port of said shuttle valve;

a poppet valve, said poppet valve having an entry port, an exit port, and a control mechanism, said poppet valve located in said handle section of said spray gun adjacent to said trigger system, said control pressure line attached to said entry port of said poppet valve, said exit port of said poppet valve attached to an air release line for receiving air from said control pressure line when said poppet valve is open;

said control mechanism of said poppet valve activated by said trigger system such that when said trigger system engages said control mechanism, said poppet valve opens allowing air from said control pressure line to flow into said air release line effecting a reduction in pressure in said pressure line and said pinch valve pressure line to a level below said preselected control pressure by allowing said pressure in said pinch valve pressure line and said pressure line to be bled off through said control pressure line;

said drop in pressure in said pressure line effecting a reduction of pressure at said control port of said shuttle valve, opening said shuttle valve;

said drop in pressure in said pinch valve pressure line effecting a reduction of pressure at said control port of said pinch valve, opening said pinch valve;

an air line having a common juncture creating a first leg, a second leg, and a third leg;

said first leg of said air line attached to said exit port of said shuttle valve, such that when said shuttle valve is open, carrier gas flows through said shuttle valve into said first leg of said air line to said common juncture;

said second leg of said air line having a first end and a second end, said first end of said second leg of said air line being attached to said common juncture, and said second end of said second leg attached to a regulator, said regulator connected to a vibrator line, the end of said vibrator line distal said regulator connected to an air operated vibrator fixedly attached to said hopper proximate to said powder metering system, such that when said shuttle valve is open, carrier gas is transported through said regulator into said vibrator line, causing said air operated vibrator to vibrate; and said third leg of said air line having a first end and a second end, said first end of said third leg connected to said common juncture, and said second end of said third leg of said air line being connected to a rate control bleed valve, said rate control bleed valve attached to an air operated cylinder attached to a spring attached to a deadman control valve regulating the flow of flame supply gases to said spray gun, such that when said shuttle valve is open, carrier gas is transported to said air operated cylinder, which causes said air operated cylinder to activate said spring which opens said deadman control valve and allows said flame supply gases to be transported to said spray gun.

27. The apparatus of claim 26 wherein said powder metering system is connected to said hopper for supplying said powder to said spray gun;

said powder metering system comprising, a powder adjustment mechanism;

a housing having a powder passage, an air passage, and a powder adjustment passage for receiving said powder adjustment mechanism; and a tube interconnecting said powder passage, said air passage, and said powder adjustment passage.

28. The apparatus of claim 27 wherein said gas supply system further comprises:

a propane source and an oxygen source;

said propane source and said oxygen source attached to said deadman control valve.

29. A method of controlling the application of thermoplastic powdered material onto surfaces, comprising the steps of:

checking all connections on a flame spray system comprised of a powder generation system, a gas supply system for supplying gases for said flame, a centrally located control system regulated by pressurized carrier gas, and a spray gun;

said spray gun further comprising:

a shaft section attached to a handle section;

a trigger system communicating with said centrally located control system for controlling the release of said thermoplastic powdered material and said gases from said gas supply system, said trigger system adjacent to the intersection of said shaft section and said handle section;

a gas control mechanism attached to said shaft section of said spray gun;

a gas mixing mechanism contiguous to said shaft section distal from said intersection of said shaft section and said handle section; and a powder nozzle having a first end and a second end, said first end interposed in said shaft section of said gun and said second end communicating with said powder generation system;

filling said powder generation system with said thermoplastic powdered material;

pressurizing said flame spray system with pressurized carrier gas;

adjusting the amount of pressure going to said centrally located control system;

adjusting the amount of powder flowing from said powder generation system to said spray gun;

purging said gas supply system to assure gas is available to said gas control mechanism attached to said shaft section of said spray gun;

releasing said gases from said gas mixing mechanism by activating said trigger system;

lighting said gas released from said gas mixing mechanism contiguous to said shaft section of said spray gun;

adjusting the flame produced by the lighting of said gases from said gas mixing mechanism by adjusting the quantity of gases released from said gas control mechanism attached to said shaft section of said spray gun; and releasing said powder from said powder generation system by activating said trigger system.

* * * * *